US005277639A

United States Patent [19]

Nagata et al.

[11] Patent Number: 5,277,639

[45] Date of Patent: Jan. 11, 1994

[54] ARC TUBE ELECTRODE ASSEMBLY AND METHOD FOR MANUFACTURING SAME

[75] Inventors: Akihiro Nagata; Kunio Fukai, both of Shizuoka, Japan

[73] Assignee: Koito Manufacturing Co., Ltd., Tokyo, Japan

[21] Appl. No.: 985,967

[22] Filed: Dec. 4, 1992

[30] Foreign Application Priority Data

Dec. 9, 1991 [JP] Japan ..... 3-324496

[51] Int. Cl.[5] ..... H01J 9/18

[52] U.S. Cl. ..... 445/26; 174/50.64

[58] Field of Search ..... 445/26, 27, 43, 44; 174/50.64

[56] References Cited

U.S. PATENT DOCUMENTS 3,231,710 1/1966 Barnet et al. ..... 219/56.22
3,868,528 2/1975 Lake et al. ..... 174/50.64 X
3,959,682 5/1976 Wesselink et al. ..... 174/50.64 X
5,097,100 3/1992 Jackson ..... 219/56.22 X

OTHER PUBLICATIONS

Kearns, W. H. (editor) *Welding Handbook* vol. 3 Seventh Edition 1980 pp. 16-22.

*Primary Examiner*—Kenneth J. Ramsey
*Attorney, Agent, or Firm*—Sughrue, Mion, Zinn, Macpeak & Seas

[57] ABSTRACT

An electrode assembly for an arc tube which is free from the difficulty that tearing of a foil occurs in pinch-sealing the arc tube. One end portion of an electrode bar is overlapped with a molybdenum foil, and the electrode bar is connected to the molybdenum foil by spot-welding the overlapped portions of the two members, except for the tip end part of the end portion of the electrode bar, whereby the molybdenum foil is prevented from being damaged by the rectangular corner of the end portion of the electrode bar.

4 Claims, 2 Drawing Sheets

ARC TUBE ELECTRODE ASSEMBLY AND METHOD FOR MANUFACTURING SAME

BACKGROUND OF THE INVENTION

The present invention relates to an electrode assembly which is sealingly fitted in an arc tube forming a light source of a discharge lamp unit. More particularly, the invention relates to an electrode assembly for an arc tube in which a molybdenum foil is connected to an electrode bar by spot welding, and to a method for manufacturing the electrode assembly.

FIG. 5 is a sectional view of an arc tube. The arc tube 1 includes a pair of electrode assemblies 3 inserted into a glass tube, the latter being sealed at both ends to form pinch-seal portions 2*b* which sealingly fix the electrode assemblies 3, and a closed glass ball 2*b* between the pinch-seal portions 3. The electrode assemblies 3 have respective electrode bars 5 which protrude into the glass ball 2*b*, and lead wires 6 which extend to the outside from the respective pinch-seal portion 2*a*. More specifically, each of the electrode assemblies 3, as shown in FIG. 5, includes an elongated molybdenum foil 4. The electrode bar 5 is welded to one end of the molybdenum foil 4, and the lead wire 6 is welded to the other end of the molybdenum foil 4. In FIG. 6, reference numeral 8 designates spot-welded regions of the electrode assembly.

In manufacturing the electrode assembly 3, as shown in FIG. 7, the molybdenum foil 4 and the electrode bar 5 are overlapped with each other, and then spot-welded with the overlapped portions 7 clamped with spot-welding electrodes 8*a*and 8*b*. In general, the electrode bar is made of tungsten, and therefore its weldability with the molybdenum foil is not high. Hence, the welding operation is carried out with the electrode bar 5 and the molybdenum foil 4 pressed against each other. As a result, sometimes the soft molybdenum foil 4 is scratched by the rectangular corner $5a_1$ of the end portion 5*a* of the electrode bar 5, and thus it can be cracked. Since the electrode bar 5 is formed by cutting a belt-shaped electrode bar material into a predetermined length, the electrode bar 5 may have burrs at the end $5a_1$, or acute-angled cut ends. In such a case, the above-described difficulty in the manufacture of the electrode assembly is especially prevalent. If the molybdenum foil 4 is cracked, then, in the pinch-sealing step employed in manufacturing the arc tube, the molybdenum foil may tear, as shown in FIG. 8.

SUMMARY OF THE INVENTION

In view of the foregoing, an object of the invention is to provide an arc tube electrode assembly which is free from foil-tearing problems in the pinch-sealing step, and a method for manufacturing such an electrode assembly.

In order to achieve the foregoing and other objects of the invention, there is provided an electrode assembly for an arc tube which is formed by overlapping an end portion of an electrode bar with a molybdenum foil and connecting the electrode bar to the molybdenum foil by spot-welding the overlapped portions of the electrode bar and the molybdenum foil, in which, in accordance with the invention, the end portion of the electrode bar overlapped with the molybdenum foil has a non-welded region at its tip end part.

In addition, there is provided a method for manufacturing an electrode assembly for an arc tube in which, for a spot welding operation, an end portion of an electrode bar is overlapped with a molybdenum foil, and the overlapped portions of the electrode bar and the molybdenum foil are clamped with a pair of spot-welding electrodes, except for the tip end part of the end portion of the electrode bar.

In welding the electrode bar to the molybdenum foil, the clamping force of the pair of spot-welding electrodes does not act on the tip end part of the electrode bar, and therefore the molybdenum foil will never be damaged by the rectangular corner of the end portion of the electrode bar although it is softer than the electrode bar.

DESCRIPTION OF THE PREFERRED EMBODIMENTS

Preferred embodiments of the invention will now be described with reference to the accompanying drawings.

Figure 1:
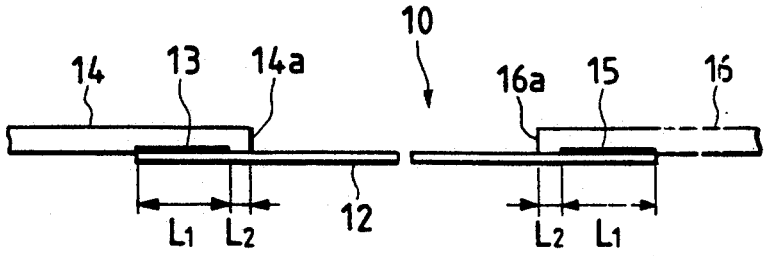
FIG. 1 is a front view of an example of an electrode assembly for an arc tube constructed in accordance with a first embodiment of the invention.
Figure 2:
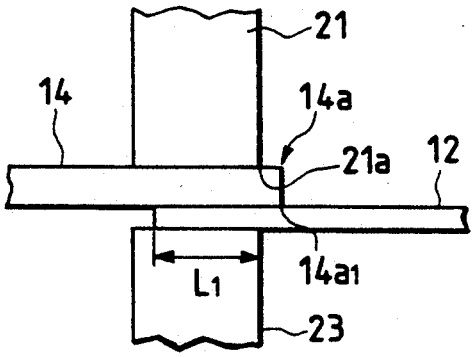
FIG. 2 is a diagram for a description of the manufacture of the electrode assembly of FIG. 1.

FIGS. 1 and 2 show a first embodiment of the invention. More specifically, FIG. 1 is a front view of an arc tube electrode assembly with a molybdenum foil held horizontal, and FIG. 2 is a diagram illustrating a method for manufacturing the electrode assembly shown in FIG. 1.

As shown in FIGS. 1 and 2, the electrode assembly 10 includes a rectangular molybdenum foil 12, an electrode bar 14 made of tungsten and spot-welded to one end of the molybdenum foil 12, and a lead wire 16 of molybdenum spot-welded to the other end of the molybdenum foil 12. In FIGS. 1 and 2, reference numeral 13 designates the weld of the molybdenum foil 12 and the electrode bar 14, and 15, the weld of the molybdenum foil 12 and the lead wire 16. That is, the electrode bar 14 and the lead wire 16 are welded to the molybdenum foil 12 except for the tip end parts 14*a* and 16*a* thereof, which are the considerably short outermost parts of the electrode bar and the molybdenum foil. Further in FIGS. 1 and 2, $L_1$ designates spot-welding regions or portions, and $L_2$, non-spot-welding regions or portions.

The electrode assembly shown in FIG. 1 is manufactured as follows:

First, one end portion of the molybdenum foil 12 is placed on the lower spot-welding electrode 23, and then the end portion of the electrode bar 14 is set on the molybdenum foil 12. Under this condition, the upper spot-welding electrode 21 is moved downward so that the overlapped portions of the molybdenum foil and the electrode bar are clamped by the upper and lower spot-welding electrodes 21 and 23, except for the tip end part 14a of the electrode bar 14; that is, the spot-welding portions $L_1$ are clamped by the electrodes 21 and 23. Under this condition, current is applied between the spot-welding electrodes 21 and 23 to spot-weld the electrode bar 14 to the molybdenum foil 12. Thereafter, similarly as in the welding of the electrode bar 14 to the molybdenum foil 12, one end portion of the lead wire 16 is placed-on the other end portion of the molybdenum foil 12, and the overlapped portions of the lead wire 16 and the molybdenum foil 12 are held with the upper and lower spot-welding electrodes, except for the tip end part 16a, and are then spot-welded together.

In this spot-welding operation, the tip end part 14a of the electrode bar 14 is positioned outside the end portion 21a of the upper spot-welding electrode 21. Hence, the clamping force acting on the two members 12 and 14 does not act on the tip end part 14a of the electrode bar and the molybdenum foil 12. Therefore, the manufacture of the electrode assembly according to the invention is free from the difficulty that the molybdenum foil 14, being softer than tungsten, is damaged or broken by the corner 14a, of the tip end part 14a of the electrode bar 14. Similarly, the weld of the molybdenum foil 12 and the lead wire 16 is free from the difficulty that the molybdenum foil 12 is damaged or broken.

In the above-described embodiment, the electrode bar 14 is welded to the molybdenum foil 12 before the lead wire 16 is welded thereto. However, the lead wire 16 can be welded to the molybdenum foil 12 before the electrode bar 14, or the lead wire 16 and the electrode bar 14 can be welded to the molybdenum foil 12 at the same time.

Figure 3:
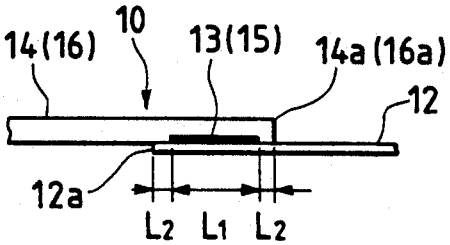
FIG. 3 is a front view of an electrode assembly constructed in accordance with a second embodiment of the invention.
Figure 4:
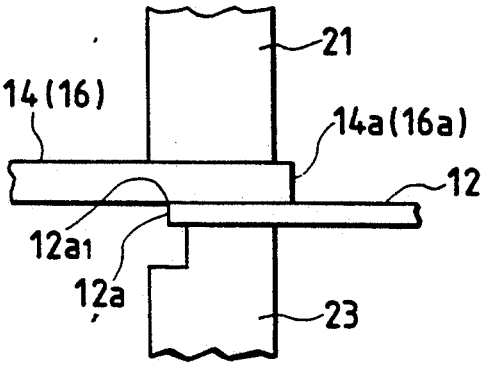
FIG. 4 is a diagram for a description of the manufacture of the electrode assembly shown in FIG. 3.
Figure 5:
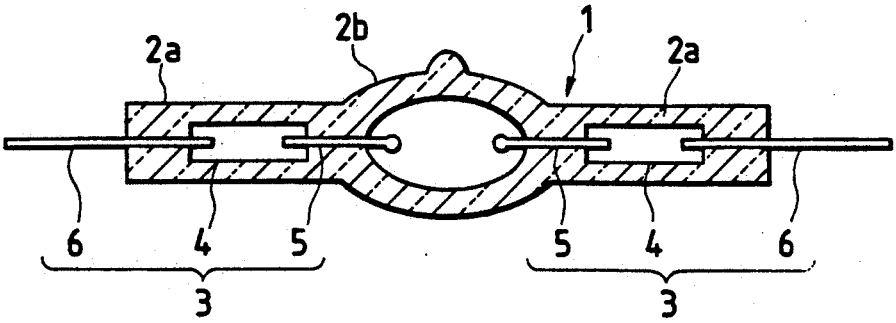
FIG. 5 PRIOR ART
FIG. 5 is a sectional view of an arc tube.
Figure 6:
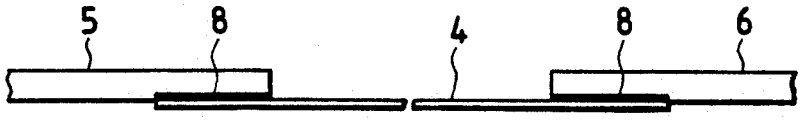
FIG. 6 PRIOR ART
FIGS. 6 and 7 are views of a conventional electrode assembly for an arc tube.

FIGS. 3 and 4, corresponding respectively, to FIGS. 1 and 2, show another example of the electrode assembly, which constitutes a second embodiment of the invention.

In an electrode assembly 10, non-welded portions $L_2$ are provided for both the electrode bar 14 (or the lead wire 16) and the molybdenum foil 12. More specifically, the tip end part 14a of the electrode bar 14 (or the lead wire 16) and the tip end part 12a of the molybdenum foil 12 are provided as the non-welded part $L_2$. That is, the overlapped portions of the two members 12 and 14 are spot-welded, except for the tip end parts thereof. In other words, the welding parts $L_1$ next to the tip end parts 12a and 14a are spot-welded.

Figure 7:
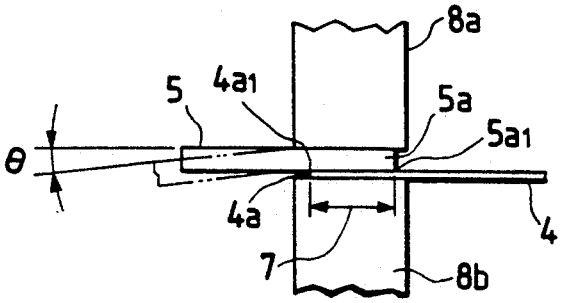
FIG. 7 PRIOR ART
Figure 8:
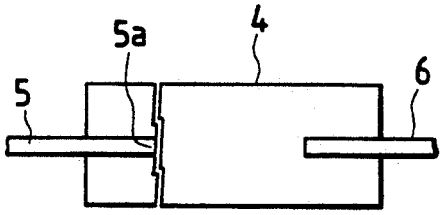
FIG. 8 PRIOR ART
FIG. 8 is a diagram for a description of a foil-tearing problem.

The electrode assembly shown in FIG. 3 is manufactured as follows:

As shown in FIG. 4, the end portion of the lower spot-welding electrode 23 on the side of the molybdenum foil 12 is partially cut so as to reduce its contact area with the molybdenum foil. Thus, the overlapped portions of the molybdenum foil 12 and the electrode bar 14 are clamped with the upper and lower spot-welding electrodes 23 and 21, except for the tip end parts 14a (or 16a) of the electrode bar 14 (or the lead wire 16) and the tip end part 12a of the molybdenum foil 12. As shown in FIG. 7, in the case where the clamping force of the spot-welding electrodes acts on the end portion 4a of the molybdenum foil 4, the corner $4a_1$ of the end portion of the molybdenum foil, being softer than the electrode bar 5 of tungsten, is collapsed by the electrode bar 5, so that the electrode 5 and the molybdenum foil 4 may be inclined as much as an angle $\theta$ when the electrode bar 5 is welded to the molybdenum foil 4. However, in this embodiment, in the step of welding the electrode bar 14 (or the lead wire 16) to the molybdenum foil 12, the clamping force acting on the two members 12 and 14 (or 16) does not act on the tip end part 14a(or 16) of the electrode bar 14 (the lead wire 16) or the tip end part 14a of the molybdenum foil 12. Hence, the molybdenum foil 12 will not be damaged by the tip end part 14a(or 16a), and the electrode bar 14 (the lead wire 16) and the molybdenum foil 12 will not be inclined when the former is welded to the latter.

As is apparent from the above description, the arc tube electrode assembly of the invention has the following effects or merits: In welding the electrode bar to the molybdenum foil, the clamping force of the pair of spot-welding electrodes does not act on the tip end part of the electrode bar, and therefore the molybdenum foil will never be damaged by the rectangular corner of the end portion of the electrode bar although it is softer than the electrode bar. Thus, in the step of pinch-sealing the arc tube during manufacture, the above-described foil-tearing problem will not occur.

What is claimed is:

1. In an electrode assembly for an arc tube formed by overlapping an end portion of an electrode bar with a soft, thin molybdenum foil, and by connecting said electrode bar to said molybdenum foil by spot-welding the overlapped portions of said electrode bar and said molybdenum foil, the improvement wherein said end portion of said electrode bar overlapped with said molybdenum foil has a non-welded region at the tip end part thereof, said molybdenum foil extending beyond said tip end part of said electrode bar.

2. The electrode assembly for an arc tube of claim 1, wherein said molybdenum foil has a non-welded region at a tip end part thereof.

3. In a method for manufacturing an electrode assembly for an arc tube in which an end portion of an electrode bar is overlapped with a soft, thin molybdenum foil, and the overlapped portions of said electrode bar and said molybdenum foil are clamped with a pair of spot-welding electrodes, the improvement wherein said overlapped portions are clamped with said pair of spot-welding electrodes except for a tip end part of said end portion of said electrode bar, said molybdenum foil extending beyond said tip end part of said electrode bar.

4. The method for manufacturing an electrode assembly of claim 3, wherein said overlapped portions are clamped with said pair of spot-welding electrodes except for a tip end part of said end portion of said electrode bar and a tip end part of said molybdenum foil.

* * * * *